US010077615B2

(12) United States Patent
Authier

(10) Patent No.: US 10,077,615 B2
(45) Date of Patent: Sep. 18, 2018

(54) SOUND ABSORBER FOR A DRILLING APPARATUS

(71) Applicant: ASDR Canada Inc., Malartic (CA)

(72) Inventor: Stephen Authier, Val d'Or (CA)

(73) Assignee: ASDR CANADA INC., Malartic (CA)

( * ) Notice: Subject to any disclaimer, the term of this patent is extended or adjusted under 35 U.S.C. 154(b) by 132 days.

(21) Appl. No.: 15/222,354

(22) Filed: Jul. 28, 2016

(65) Prior Publication Data

US 2017/0030165 A1 Feb. 2, 2017

Related U.S. Application Data

(60) Provisional application No. 62/199,556, filed on Jul. 31, 2015.

(51) Int. Cl.

| | |
|---|---|
| ***E21B 17/07*** | (2006.01) |
| *E21B 17/10* | (2006.01) |
| *E21B 34/00* | (2006.01) |

(52) U.S. Cl.

CPC ..... *E21B 17/076* (2013.01); *E21B 17/1042* (2013.01); *E21B 2034/007* (2013.01)

(58) Field of Classification Search

CPC .... E21B 41/00; E21B 17/076; E21B 17/1042; E21B 34/00; E21B 2034/007; E21B 34/14

See application file for complete search history.

(56) References Cited

U.S. PATENT DOCUMENTS

| | | | |
|---|---|---|---|
| 1,132,375 | A | 3/1915 | George |
| 1,671,436 | A | 5/1928 | Melott |
| 1,767,350 | A | 6/1930 | Crowell |
| 2,169,697 | A | 8/1939 | Kangas |
| 2,222,646 | A | 11/1940 | Burns |
| 2,240,519 | A | 5/1941 | Reed |
| 2,463,124 | A | 3/1949 | Sims |
| 2,570,577 | A | 10/1951 | Manion |
| 2,588,158 | A | 3/1952 | Peirce |
| 2,620,165 | A | 12/1952 | Crickmer |

(Continued)

FOREIGN PATENT DOCUMENTS

| | | |
|---|---|---|
| AU | 199876836 | 4/1999 |
| AU | 755961 | 1/2003 |

(Continued)

*Primary Examiner* — Yong-Suk Ro

(57) ABSTRACT

A sound absorber mountable between a drilling apparatus and a drill bit. The sound absorber defines an absorber axis therealong. The sound absorber includes a sleeve defining a chamber extending axially therealong, the chamber defining axially opposed chamber proximal and distal ends, the chamber being delimited by a chamber peripheral wall extending between the chamber proximal and distal ends and a chamber distal end wall provided at the chamber distal end, the sleeve defining a sleeve aperture leading to the chamber at the chamber proximal end. A piston is mounted to the sleeve so that at least part of the piston is in the chamber, the piston being reciprocatingly movable substantially axially along the sleeve, the piston defining axially opposed piston proximal and distal ends An absorbing system includes a first resilient element provided in the chamber between the piston distal end and the chamber distal end.

17 Claims, 5 Drawing Sheets

(56) References Cited

U.S. PATENT DOCUMENTS

| | | | |
|---|---|---|---|
| 2,620,640 | A | 12/1952 | Bales |
| 2,765,147 | A | 10/1956 | Vertson |
| 2,795,398 | A | 6/1957 | Ragland |
| 2,943,464 | A | 7/1960 | Voges |
| 2,953,351 | A | 9/1960 | Bodine et al. |
| 3,033,011 | A | 5/1962 | Garrett |
| 3,099,918 | A | 8/1963 | Garrett |
| 3,135,103 | A | 6/1964 | Black |
| 3,183,684 | A | 5/1965 | Zeidler |
| 3,223,187 | A | 12/1965 | Cleary |
| 3,232,362 | A | 2/1966 | Cullen et al. |
| 3,257,827 | A | 6/1966 | Hughes |
| 3,258,283 | A | 6/1966 | Winberg et al. |
| 3,263,446 | A | 8/1966 | Wiggins, Jr. |
| 3,274,798 | A | 9/1966 | Wiggins, Jr. |
| 3,301,009 | A | 1/1967 | Coulter |
| 3,306,078 | A | 2/1967 | Hughes |
| 3,323,326 | A | 6/1967 | Vertson |
| 3,339,380 | A | 9/1967 | Fox |
| 3,383,126 | A | 5/1968 | Salvatori et al. |
| 3,503,224 | A | 3/1970 | Grigore |
| 3,926,265 | A | 12/1975 | Bouyoucos |
| 3,998,443 | A | 12/1976 | Webb |
| 4,034,575 | A | 7/1977 | Barth |
| 4,162,619 | A | 7/1979 | Nixon, Jr. |
| 4,228,664 | A | 10/1980 | McCoy |
| 4,518,368 | A | 5/1985 | Peretti |
| 4,526,241 | A | 7/1985 | Anders |
| 4,566,546 | A | 1/1986 | Evans |
| 5,083,623 | A | 1/1992 | Barrington |
| 5,224,898 | A | 7/1993 | Johnson et al. |
| 5,372,548 | A | 12/1994 | Wohlfeld |
| 5,447,472 | A | 9/1995 | Ide |
| 5,476,421 | A | 12/1995 | Moore et al. |
| 5,772,514 | A | 6/1998 | Moore |
| 5,803,182 | A | 9/1998 | Bakke |
| 5,833,541 | A | 11/1998 | Turner et al. |
| 6,290,004 | B1 | 9/2001 | Evans |
| 6,332,841 | B1 | 12/2001 | Secord |
| 6,808,455 | B1 | 10/2004 | Solorenko et al. |
| 7,147,065 | B2 | 12/2006 | Tjader |
| 7,290,604 | B2 | 11/2007 | Evans |
| 7,434,848 | B2 | 10/2008 | Boyd |
| 7,578,360 | B2 | 8/2009 | Haughom |
| 7,654,344 | B2 | 2/2010 | Haughom et al. |
| 7,954,225 | B2 | 6/2011 | Webb |
| 8,550,155 | B2 | 10/2013 | Schultz et al. |
| 8,950,477 | B2 | 2/2015 | Vagapov et al. |
| 8,992,334 | B2 | 3/2015 | Sato et al. |
| 9,334,698 | B2 | 5/2016 | Hansen |
| 2003/0220146 | A1 | 11/2003 | Bonninger et al. |
| 2006/0196676 | A1* | 9/2006 | Stoesz ..... E21B 17/06 166/377 |
| 2009/0166026 | A1 | 7/2009 | Akselberg |
| 2010/0044113 | A1 | 2/2010 | Leblanc et al. |
| 2015/0167424 | A1* | 6/2015 | Richards ..... E21B 33/134 166/386 |

FOREIGN PATENT DOCUMENTS

| | | | |
|---|---|---|---|
| CA | 2681471 | A1 | 9/2008 |
| CA | 2848114 | A1 | 3/2013 |
| DE | 1956210 | A1 | 5/1971 |
| EP | 261002 | | 4/1981 |
| EP | 2578795 | A1 | 4/2013 |
| GB | 991460 | A | 5/1965 |
| JP | 2004286181 | A | 10/2004 |
| WO | 2007114706 | A1 | 10/2007 |

* cited by examiner

SOUND ABSORBER FOR A DRILLING APPARATUS

FIELD OF THE INVENTION

The present invention relates generally to the field of drilling. More specifically, the present invention is concerned with a sound absorber for a drilling apparatus.

BACKGROUND OF THE INVENTION

Drilling, for example in the mining and geological exploration industries, is a noisy process. In addition to presenting danger to the hearing capacity of workers adjacent the drilling equipment, the noise and can be highly undesirable if drilling occurs close to inhabited locations.

Against this background, there exists a need in the industry to provide a sound absorber for a drilling apparatus.

An object of the present invention is therefore to provide such a sound absorber.

SUMMARY OF THE INVENTION

In a broad aspect, the invention provides a sound absorber mountable between a drilling apparatus and a drill bit, the sound absorber defining an absorber axis therealong, the sound absorber including: a sleeve defining a chamber extending axially therealong, the chamber defining axially opposed chamber proximal and distal ends, the chamber being delimited by a chamber peripheral wall extending between the chamber proximal and distal ends and a chamber distal end wall provided at the chamber distal end, the sleeve defining a sleeve aperture leading to the chamber at the chamber proximal end; a piston mounted to the sleeve so that at least part of the piston is in the chamber, the piston being reciprocatingly movable substantially axially along the sleeve, the piston defining axially opposed piston proximal and distal ends; and an absorbing system including a first resilient element provided in the chamber between the piston distal end and the chamber distal end.

The invention may also provide a sound absorber wherein the first resilient element is made of an elastomer.

The invention may also provide a sound absorber wherein the first resilient element is made of polypropylene.

The invention may also provide a sound absorber wherein the absorbing system further includes a second resilient element extending circumferencially around the piston and provided between the piston and the chamber, the second resilient element spacing apart the piston and the chamber peripheral wall from each other.

The invention may also provide a sound absorber wherein the absorbing system further includes a third resilient element extending circumferencially around the piston and provided between the piston and the chamber, the third resilient element spacing apart the piston and the chamber peripheral wall from each other, the second and third resilient elements being axially spaced apart from each other.

The invention may also provide a sound absorber wherein the second resilient element is substantially annular.

The invention may also provide a sound absorber wherein the piston defines an annular groove extending substantially circumferentially therearound, the second resilient element being mounted in the annular groove.

The invention may also provide a sound absorber wherein the second resilient element is provided substantially adjacent the chamber proximal end.

The invention may also provide a sound absorber wherein the second resilient element is made of an elastomer.

The invention may also provide a sound absorber wherein the second resilient element is made of a nitrile elastomer.

The invention may also provide a sound absorber wherein the first resilient element defines a resilient element passageway extending axially therethrough, the sound absorber further comprising a shaft extending through the first resilient element.

The invention may also provide a sound absorber wherein the sleeve distal end wall is provided with a shaft receiving recess receiving part of the shaft thereinto, the shaft receiving recess being of a length sufficient to allow the shaft to move reciprocatingly thereinto when the piston and sleeve move axially relative to each other.

The invention may also provide a sound absorber wherein the chamber and piston have generally cylindrical shapes.

The invention may also provide a sound absorber further comprising a lock element extending between the piston and the sleeve to substantially prevent relative rotation of the piston and sleeve about the absorber axis.

The invention may also provide a sound absorber wherein the sleeve defines a pair of substantially diametrically opposed sleeve lock apertures extending substantially radially therethrough and the piston defines a piston lock aperture extending substantially diametrically therethrough substantially in register with the sleeve lock apertures, the lock element extending through the sleeve and piston lock apertures, the piston lock aperture being axially longer than the lock element.

The invention may also provide a sound absorber wherein the sound absorber defines an absorber passageway extending axially therethrough, the absorber passageway having parts thereof extending trough both the sleeve and the piston.

The invention may also provide a sound absorber wherein the piston defines a piston attachment at the piston proximal end and the sleeve define a sleeve attachment distally to the chamber distal end, the piston and sleeve attachments being configured and sized to mount the sound absorber between the drilling apparatus and the drill bit.

The first resilient element, and in some embodiments the second resilient element, includes a material that dissipates vibrations at frequencies found in the undesirable sound produced during the drilling process.

Advantageously, the proposed sound absorber is relatively simple to manufacture and maintain and can consequently be relatively inexpensive to buy and maintain. Furthermore, in some embodiments of the invention, the proposed sound absorber is retrofittable to existing drilling equipment.

In another broad aspect, the invention provides a sound absorber for a drilling apparatus, the sound absorber being usable with a drill bit, the sound absorber including: an apparatus attachment for attaching the sound absorber to the drilling apparatus; a drill bit attachment for attaching the drill bit thereto; and a vibration absorbing element provided between the apparatus and drill bit attachments. The apparatus and drill bit attachments are spaced apart from each other by the vibration absorbing element.

The present application claims priority from U.S. provisional application 62/199,556, the contents of which is hereby incorporated by reference in its entirety.

Other objects, advantages and features of the present invention will become more apparent upon reading of the following non-restrictive description of preferred embodiments thereof, given by way of example only with reference to the accompanying drawings.

DETAILED DESCRIPTION

In the present document, the terminology distal and proximal refers to the distance from an operator located outside of a bore being drilled. Therefore, proximal elements are closer to the operator than distal elements. This terminology is used to facilitate the description of the invention and should not be used to restrict the scope of the present invention. Also, the terminology "substantially" is used to denote variations in the thus qualified terms that have no significant effect on the principle of operation of the invention. These variations may be minor variations in design or variations due to mechanical tolerances in manufacturing and use of the invention. These variations are to be seen with the eye of the reader skilled in the art.

Figure 1:
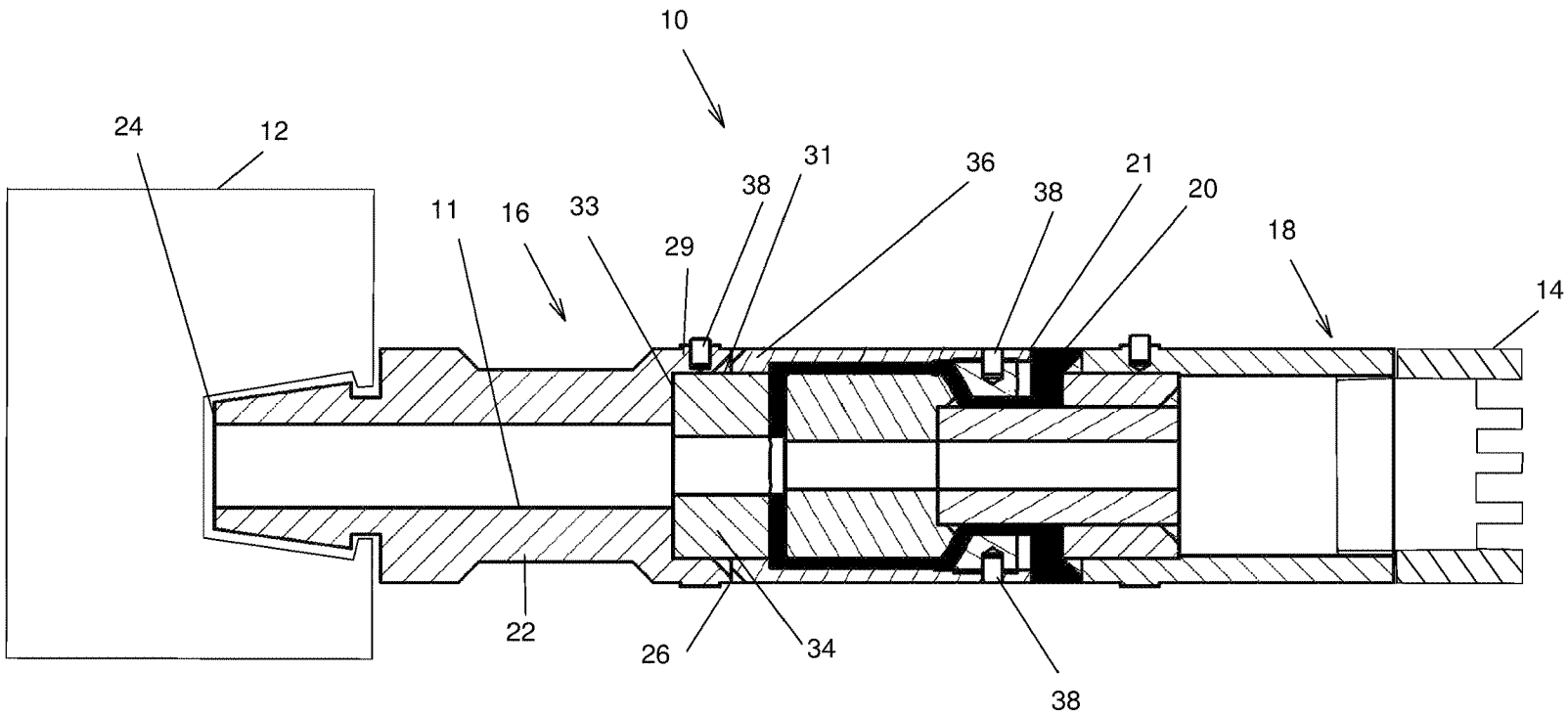
FIG. 1, in a side cross-sectional view, illustrates a sound absorber in accordance with an embodiment of the present invention.
Figure 2:
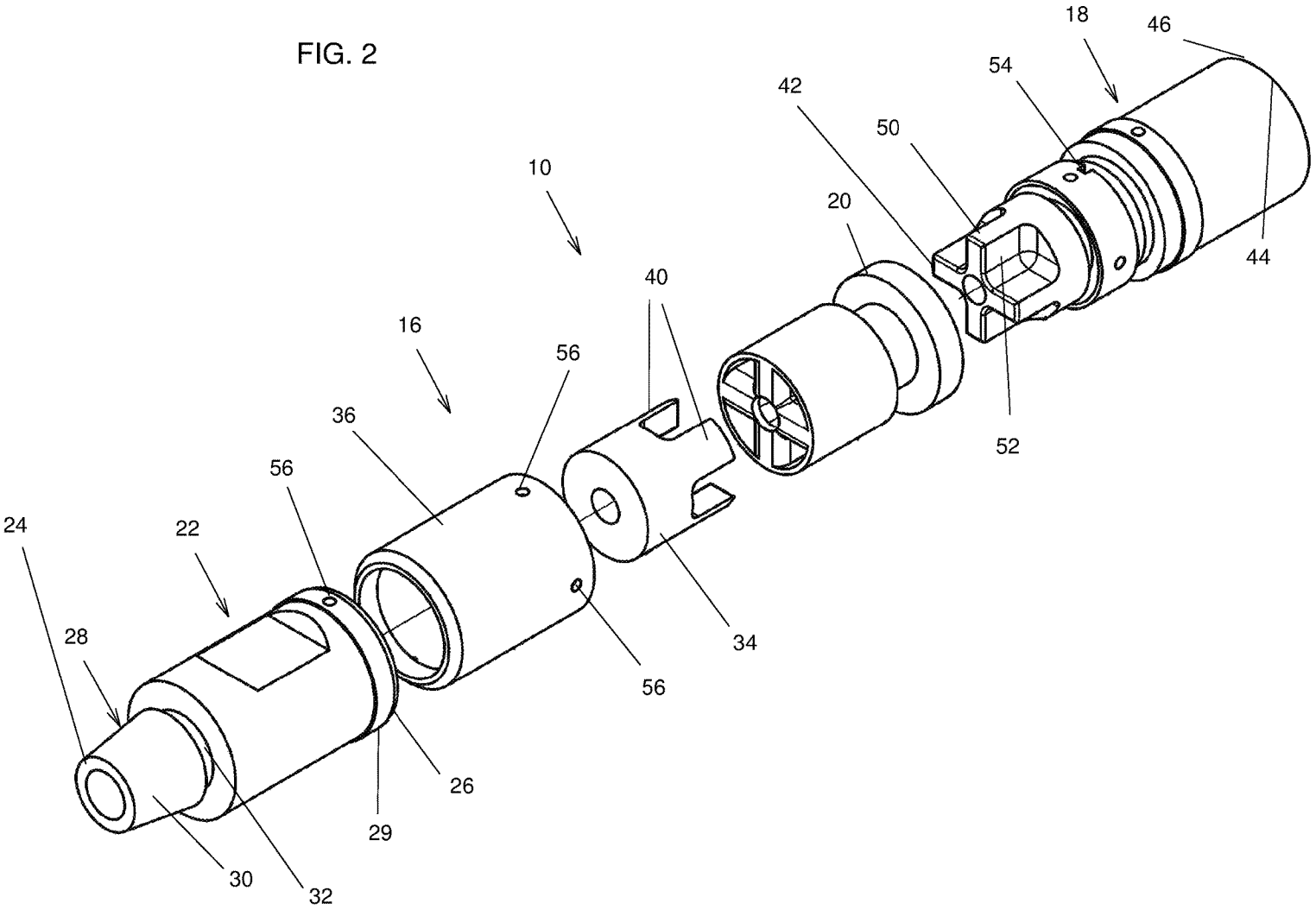
FIG. 2, in a perspective exploded view, illustrates the sound absorber shown in FIG. 1.

With reference to FIGS. 1 and 2, there is shown a sound absorber 10 in accordance with an embodiment of the present invention. The sound absorber 10 is attachable to a drilling apparatus 12 and usable with a drill bit 14, both shown schematically in FIG. 1. The sound absorber 10 includes an apparatus attachment 16 for attaching the sound absorber 10 to the drilling apparatus 12 and a drill bit attachment 18 for attaching the drill bit 14 thereto. A vibration absorbing element 20 is provided between the apparatus and drill bit attachments 16 and 18. The apparatus and drill bit attachments 16 and 18 are spaced apart from each other by the vibration absorbing element 20. In some embodiments, the vibration absorbing element 20 is provided at each location between the apparatus and drill bit attachments 16 and 18 so that the apparatus and drill bit attachments 16 and 18 do not directly contact each other.

In other words, mechanical link between the apparatus and drill bit attachments 16 and 18 is provided by the vibration absorbing element 20. Therefore, the vibration absorbing element 20 fills, at least partially and typically completely, a gap 21 extending between the apparatus and drill bit attachments 16 and 18.

In some embodiments of the invention, the sound absorber 10 is hollow and defines a passageway 11 extending therethrough. The passageway 11 is usable to allow a fluid (not shown in the drawings) to reach the drill bit 14, as in many conventional drilling processes. However, in alternative embodiments of the invention, no passageway 11 is provided.

As better seen in FIG. 2, the apparatus attachment 16 includes a drilling apparatus attachment body 22 of generally elongated configuration defining opposed drilling apparatus attachment body proximal and distal ends 24 and 26. For the purpose of this document, proximal elements are closer to the drilling apparatus 12 than distal elements when the sound absorber 10 is in use. The apparatus attachment 16 also includes an apparatus attachment interlinking element 34 and an apparatus attachment collar 36, both provided distally relative to the drilling apparatus attachment body 22.

The drilling apparatus attachment body 22 defines an apparatus coupling section 28 for coupling to the drilling apparatus 12. The apparatus coupling section 28 is provided adjacent the drilling apparatus attachment body proximal end 24. The apparatus coupling section 28 is of shape suitable to be attached to a conventional drilling apparatus 12. For example, the apparatus coupling section 28 includes a proximally located frusto-conical portion 30 and a neck 32 extending in a distal direction therefrom.

As seen in FIG. 1, the drilling apparatus attachment body 22 also defines an interlinking element coupling section 29 provided adjacent the drilling apparatus attachment body distal end 26. The interlinking element coupling section 29 defines a recess 31 extending into the drilling apparatus attachment body 22 towards the drilling apparatus attachment body proximal end 24. For example, the recess 31 is generally annular. The recess 31 is terminated proximally by a shoulder 33.

The apparatus attachment interlinking element 34 is used to secure the apparatus and drill bit attachments 16 and 18 to each other, as described in further details herein below. As better seen in FIG. 2, the apparatus attachment interlinking element 34 is generally cylindrical and defines distally extending legs 40. The apparatus attachment interlinking element 34 is partially inserted at its proximal end in the recess 31 and abuts against the shoulder 33, as seen in FIG. 1.

The apparatus attachment collar 36 is provided radially outwardly relative to the apparatus attachment interlinking element 34 and protrudes distally therefrom. The apparatus attachment collar 36, at the proximal end thereof, abuts against the drilling apparatus attachment body 22.

Referring to FIG. 2, the drill bit attachment 18 is generally elongated and defines opposed drill bit attachment proximal and distal ends 42 and 44. The drill bit attachment 18 includes a drill bit coupling section 46 adjacent the drill bit attachment distal end 44 and a drill bit attachment interlinking section 50 adjacent the drill bit attachment proximal end 42.

The drill bit coupling section 46 is used to attach the drill bit 14 thereto. The drill bit 14 is either directly attached to the drill bit coupling section 46, or the drill bit 14 itself is supported by one or more elongated tubes that themselves attach to the drill bit coupling section 46. For example, the drill bit coupling section 46 is hollow and defines internally provided threads (not shown in the drawings) usable to screw the drill bit thereto.

The drill bit attachment interlinking section 50 is used to link the drill bit attachment 18 to the apparatus attachment 16, and more specifically to the apparatus attachment interlinking element 34. To that effect, the drill bit attachment interlinking section 50 defines linking recesses 52 extending longitudinally therealong for receiving the legs 40 thereinto. The apparatus attachment collar 36 extends around the drill bit coupling section 46. The drill bit attachment interlinking section 50 is typically of a smaller diameter than distally extending portions of the drill bit attachment 18.

A coupling collar 54 is provided distally relative to the linking recesses 52 between the drill bit attachment 18 and the apparatus attachment collar 36.

Locking elements 38, seen in FIG. 1, are usable to secure the various components described hereinabove. For example, the locking elements 38 take the form of screws 38 extending through suitably formed apertures 56, seen in FIG. 2. A locking element 38 extends through the drilling apparatus attachment body 22 and abuts against the apparatus attachment interlinking element 34. Two or more locking element 38 extend through the apparatus attachment collar 36 and are received in the coupling collar 54.

The gap 21 is provided between the apparatus attachment interlinking element 34 and the drill bit attachment interlinking section 50. The gap 21 also extends between the drill bit attachment interlinking section 50 and the coupling collar 54. Finally, the coupling collar 54 and the apparatus attachment collar 36 are both longitudinally spaced apart from the drill bit attachment 18 by the gap 21. The vibration absorbing element 20 fills the gap 21.

In some embodiments of the invention, to manufacture the sound absorber 10, the sound absorber 10 is assembled without the vibration absorbing element 20. Then, the vibration absorbing element 20 in injected in liquid form in the gap 21 and cured or polymerized. The material forming the vibration absorbing element 20 is of a rigidity sufficient for transmitting the drilling force generated by the drilling apparatus 12 to the drill bit 14 while being dissipative enough to dissipate at least some of the undesirable vibrations and sounds generated by the drilling process. Absorption of the vibrations in turn leads to a reduction of the sound generated outside of the bore that is being drilled.

Figure 3:
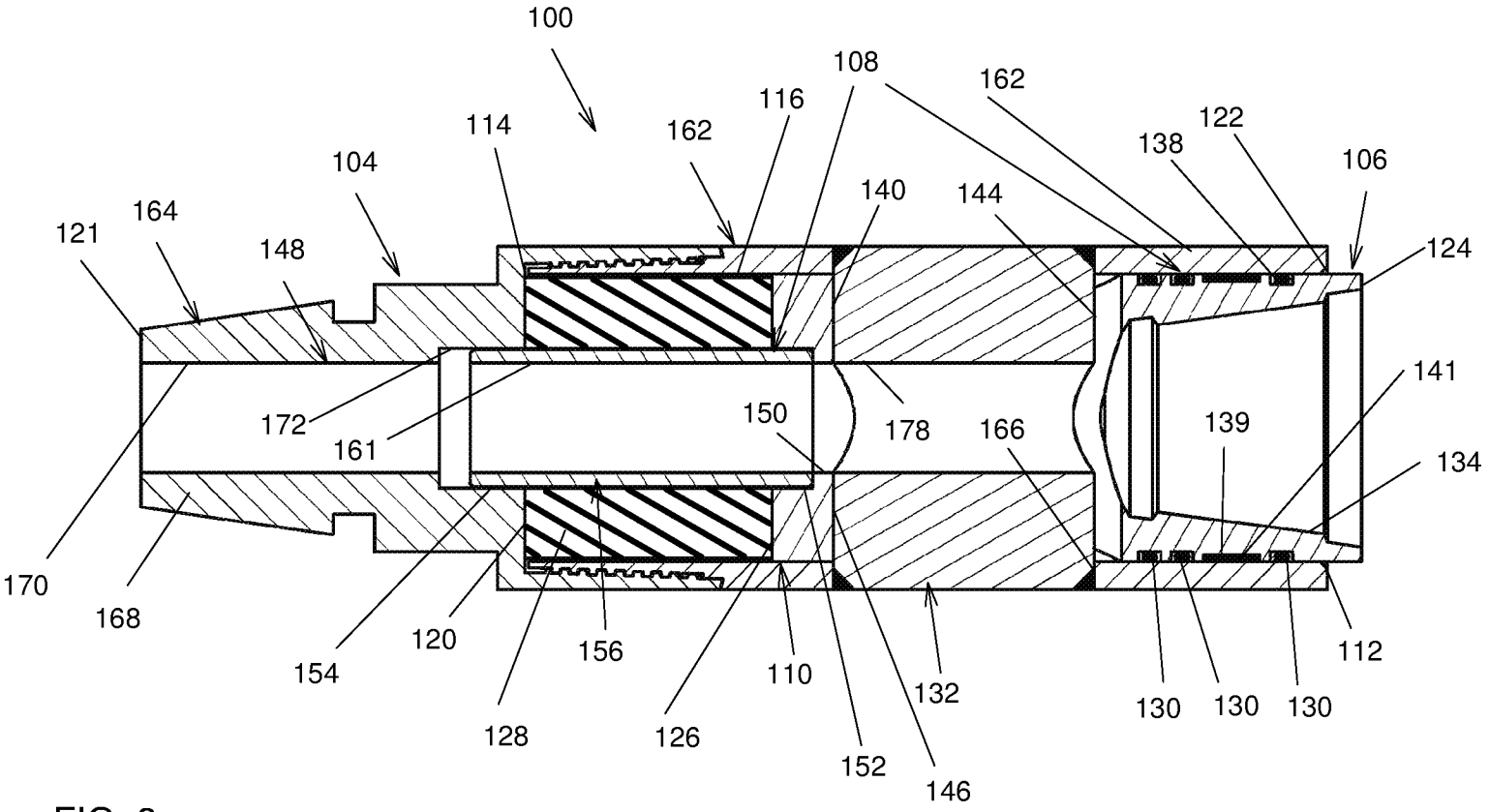
FIG. 3, in a side cross-sectional view, illustrates a sound absorber in accordance with an alternative embodiment of the present invention.
Figure 4:
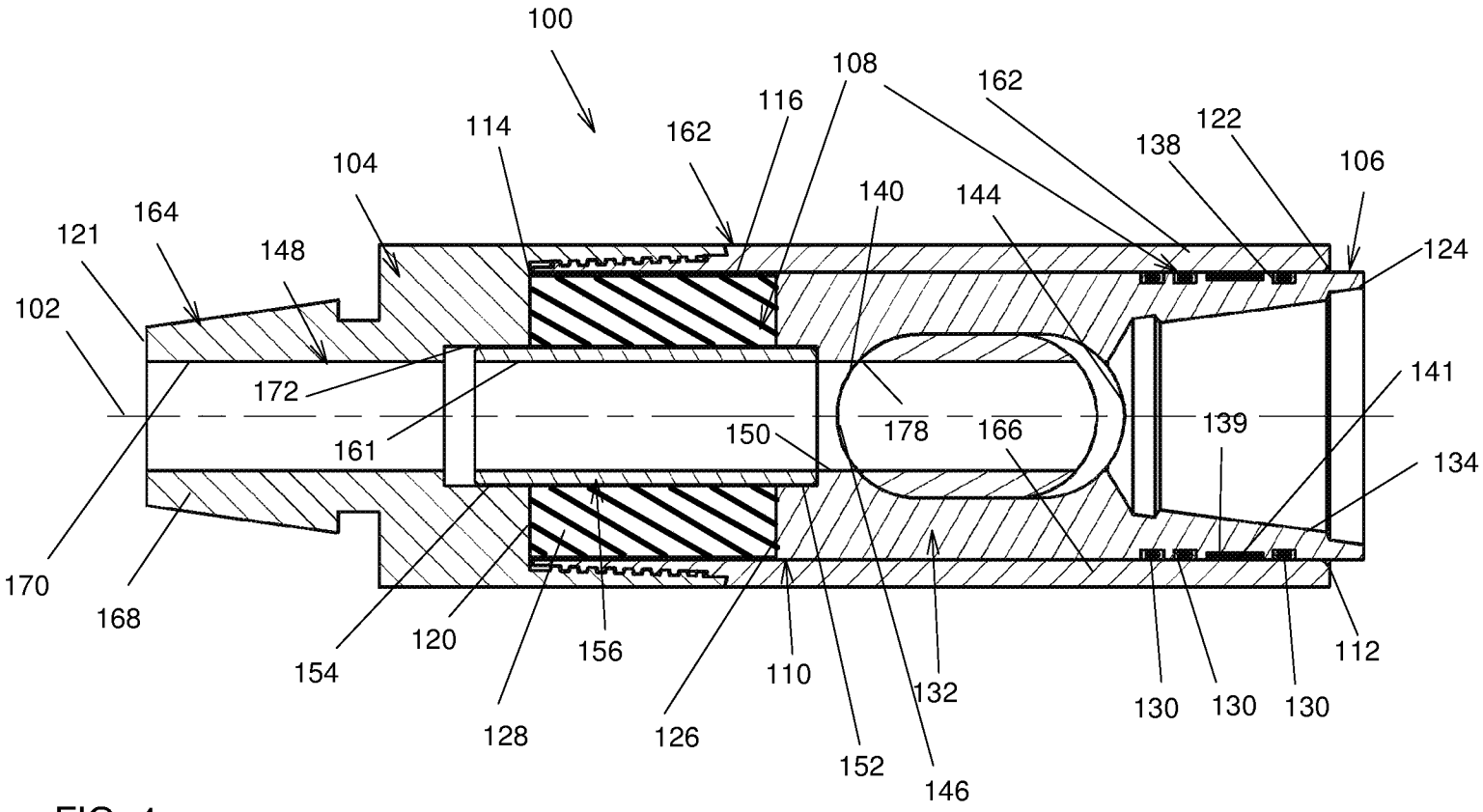
FIG. 4, in a front cross-sectional view, illustrates the sound absorber shown in FIG. 3.
Figure 5:
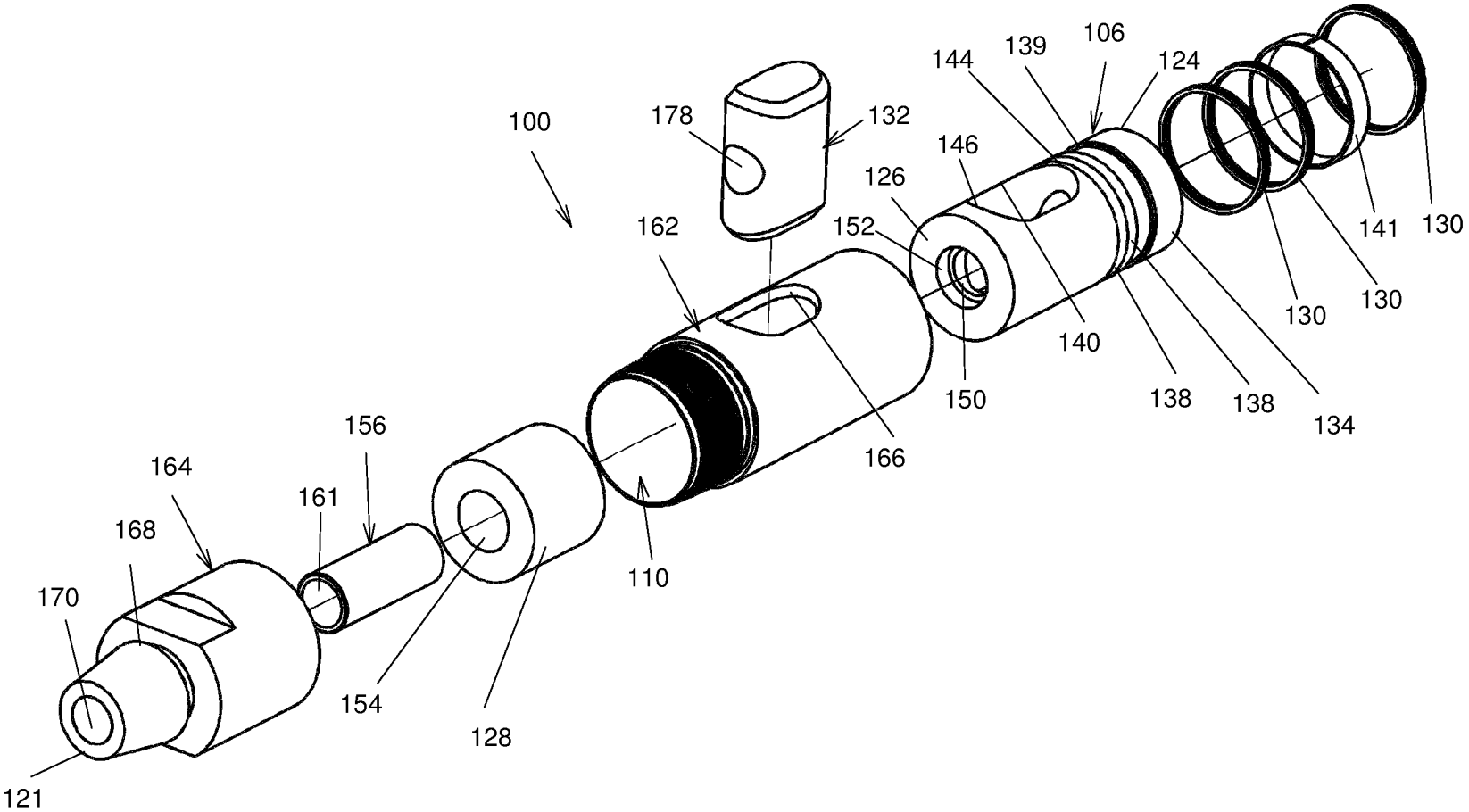
FIG. 5, in a perspective exploded view, illustrates the sound absorber shown in FIG. 3.

FIGS. 3 to 5 illustrate a sound absorber 100 in accordance with another embodiment of the present invention. Likewise the sound absorber 10, the sound absorber 100 is mountable between the drilling apparatus 12 and the drill bit 14 (both not shown in FIGS. 3 to 5). The term "between" here does not require that the sound absorber 100 be mountable between the drilling apparatus 12 and the drill bit 14. Other components used in the drilling field, such as adapter couplings, and tubes used to go deeper when drilling, may be inserted proximally, distally, or both proximally and distally to the sound absorber 100. The sound absorber 100 defines an absorber axis 102 (seen in FIG. 4 for example) therealong. In this document, the terminology "axial" refers to a direction extending along the absorber axis 102. The sound absorber 100 includes a sleeve 104, a piston 106 and an absorbing system 108.

Referring to FIG. 3, the sleeve 104 defines a chamber 110 extending axially therealong. The chamber 110 defines axially opposed chamber proximal and distal ends 112 and 114. The chamber 110 is delimited by a chamber peripheral wall 116 extending between the chamber proximal and distal ends 112 and 114 and a chamber distal end wall 120 provided at the chamber distal end 114. The sleeve 104 defines a sleeve aperture 122 leading to the chamber 110 at the chamber proximal end 112. The sleeve 104 also defines a sleeve distal end 121, distal to the chamber distal end wall 120.

The piston 106 is mounted to the sleeve 104 so that at least part of the piston 106 is in the chamber 110. Typically, the piston 106 protrudes from the chamber 110 through the sleeve aperture 122. The piston 106 is reciprocatingly movable substantially axially along the sleeve 104. The piston 106 defines axially opposed piston proximal and distal ends 124 and 126.

The absorbing system 108 is provided to dissipate at least some of the undesirable vibrations and sounds generated by the drilling process. The absorbing system 108 including a first resilient element 128 provided in the chamber 110 between the piston distal end 126 and the chamber distal end 114. The first resilient element 128 is made of a suitable material, for example an elastomer. In a specific embodiment of the invention, the elastomer is polypropylene.

In some embodiments, the absorbing system 108 also includes a second resilient element 130 extending circumferencially around the piston 106 and provided between the piston 106 and the chamber 110, the second resilient element 130 spacing apart the piston 106 and the chamber peripheral wall 116 from each other. The space between the piston 106 and the chamber peripheral wall 116 may be relatively small and is as such not visible in the drawings. In some embodiments, more than one second resilient elements 130 are provided and mounted to the piston 106 at axially spaced apart locations.

In some embodiments, the piston 106 and chamber 110 have a substantially cylindrical symmetry so that if not constrained, the piston 106 could axially rotate relative to the chamber 110. To prevent such rotation, in some embodiments, the sound absorber 100 further comprises a lock element 132 extending between the piston 106 and the sleeve 104 to prevent relative rotation of the piston 106 and sleeve 104 about the absorber axis 102. However, in alternative embodiments (not shown in the drawings), the shape of the piston 106 and chamber 110 prevent such axial rotation. This would be the case for example with a piston 106 and a chamber 110 having ellipsoidal, square or hexagonal transversal configurations, among others.

The piston 106 is generally elongated and defines, in a direction leading from the piston proximal end 124 towards the piston distal end 126, a piston attachment 134, one or more annular groove 138 and a piston lock aperture 140, the latter being typically spaced apart from the piston distal end 126. The annular grooves 138 and the piston lock aperture 140 are provide in the chamber 110.

The piston attachment 134 is configured to attach either directly to the drilling apparatus 12, or to a conventional tube (not shown in the drawings) that extend from a the drilling apparatus 12. The piston attachment 134 is configured similarly to the attachment of any conventional drilling equipment that attaches to the drilling apparatus 12 or tube.

The annular grooves 138 extend substantially circumferentially around the piston 106 are provided for mounting therein one of the second resilient elements 130. In some embodiments, an auxiliary groove 139, also extending substantially circumferentially around the piston 106, is present between two of the annular grooves 138. The auxiliary groove 139 receives a guiding ring 141 thereinto, which is typically made of a low friction material, such as for example Teflon™, and which centers the piston 106 in the sleeve 104.

The piston lock aperture 140 extends substantially diametrically through the piston 106 and defines axially opposed piston lock aperture proximal and distal ends 144 and 146. The piston lock aperture 140 is axially longer than the lock element 132. This allows axial movement of the piston 106 relative to the lock element 132. The lock element 132 abuts against the piston lock aperture proximal and distal ends 144 and 146 when the piston 106 is respectively maximally and minimally inserted in the chamber 110.

In some embodiments, the sound absorber 100 defines an absorber passageway 148 extending axially theretrough. The absorber passageway extends trough both the sleeve 104 and piston 106. The absorber passageway 148 allows flow of drilling fluid therethrough when such drilling fluid is used. In such embodiments, the piston 106 defines a piston passageway 150, which is part of the absorber passageway 148. The piston passageway 150 extends axially along the piston between the piston proximal and distal ends 124 and 126.

The central axial part of the piston lock aperture 140 is considered part of the piston passageway 150 for the purpose of this document.

The first resilient element 128 is typically made of a bulk material (as opposed to being a coil spring or other similar structure). The first resilient element 128 abuts directly against the piston distal end 126, but in alternative embodiments, other components are provided between the first resilient element 128 and the piston distal end 126. In some embodiments, the first resilient element 128 defines an axially extending resilient element passageway 154 for receiving thereinto a shaft 156, described in further details hereinbelow.

The shaft 156 is mounted through the resilient element passageway 154. When the absorber passageway 148 is present, the shaft 156 is provided with an axially extending shaft passageway 161 coaxial with the piston passageway 150. In some embodiments, the piston 106 defines a piston distal recess 152 at the piston distal end 126 for receiving part of the shaft 156 thereinto The sleeve 104 may be made of a single member, or, as in the sound absorber 100, of sleeve proximal and distal members 162 and 164, to facilitate manufacturing and assembly of the sound absorber 100. The sleeve proximal member 162 defines the sleeve aperture 122 and the chamber peripheral wall 116. The sleeve proximal member 162 is provided with a pair of substantially diametrically opposed sleeve lock apertures 166 extending substantially radially therethrough substantially in register with the piston lock aperture 140. The sleeve lock apertures 166 are typically dimensioned to snugly receive the lock element 132 thereinto.

The sleeve distal member 164 defines the chamber distal end wall 120 and is screwed or welded to the sleeve proximal member 162. The sleeve distal member 164 terminates distally with a sleeve attachment 168 that attaches to conventional drilling equipment provided distally to the sleeve attachment 168, such as tubes or the drill bit 14.

When the absorber passageway 148 is present, the sleeve 104 is provided with an axially extending sleeve passageway 170 coaxial with the piston passageway 150 and shaft passageway 161. The sleeve passageway 170 extend between the chamber distal end wall 120 and the sleeve distal end 121.

The chamber distal end wall 120 is provided with a shaft receiving recess 172 receiving part of the shaft 156 thereinto. The shaft receiving recess 172 is of a length sufficient to allow the shaft 156 to move reciprocatingly thereinto when the piston 106 and sleeve 104 move axially relative to each other. The shaft 156, received in the shaft receiving recess 172 and piston distal recess 152, centers the first resilient element 128 in the chamber 110 and provides a constant dimensions shaft passageway 161 when the first resilient element 128 is compressed.

The lock element 132 extends through the sleeve and piston lock apertures 140 and 166. Thus the lock element 132 extends over the whole diameter of the sound absorber 100. The lock element 132 mostly snugly fits in the sleeve and piston lock apertures 140 and 166, with the exception that the piston lock aperture 140 is dimensioned to allow the piston 106 to move axially relative to the lock element 132. The lock element 132 may be secured to the sleeve 104 in any suitable manner, for example and non-limitingly through welding. In some embodiments, the lock element 132 is axially elongated and guides the piston 106 as the latter moves axially.

When the absorber passageway 148 is present, the lock element 132 defines a lock element passageway 178 extending axially therethrough and axially aligned with the piston passageway 150. The lock element passageway 178 is inserted between the proximal and distal portions of the piston passageway 150.

The shaft passageway 161, piston passageway 150, sleeve passageway 170 and lock element passageway 178 together define the absorber passageway 148.

In operation, the sound absorber 100 is inserted at a suitable location between the drilling apparatus 12 and the drill bit 14. The piston 106 is pushed by the first resilient element 128 towards a proximalmost position, relative to the sleeve 104. When drilling starts, the drilling apparatus 12 presses against the piston 106, which moves to a distalmost position, relative to the sleeve 104, in which the first resilient element 128 is compressed. This compression ensures that some of the vibrations and sound caused by the drilling process are well transferred to the first resilient element 128 to be partially partially absorbed thereby. In some embodiments, when such drilling occurs, the first resilient element 128 supports compression forces in the sound absorber 120 so that the lock element 132 is spaced apart from the piston lock aperture proximal end 144 and the shaft 156 is spaced apart from at least one of against the piston 106 and the distal end of the shaft receiving recess 172. Thus, metal-to-metal contact in a longitudinal orientation in the sound absorber 100 is minimized or eliminated, which contributes to sound absorption.

Although the present invention has been described hereinabove by way of preferred embodiments thereof, it can be modified, without departing from the spirit and nature of the subject invention as defined in the appended claims.

What is claimed is:

1. A sound absorber mountable between a drilling apparatus and a drill bit, the sound absorber defining an absorber axis therealong, the sound absorber comprising:

a sleeve defining a chamber extending axially therealong, the chamber defining axially opposed chamber proximal and distal ends, the chamber being delimited by a chamber peripheral wall extending between the chamber proximal and distal ends and a chamber distal end wall provided at the chamber distal end, the sleeve defining a sleeve aperture leading to the chamber at the chamber proximal end;

a piston mounted to the sleeve so that at least part of the piston is in the chamber, the piston being reciprocatingly movable substantially axially along the sleeve, the piston defining axially opposed piston proximal and distal ends; and an absorbing system including a first resilient element provided in the chamber between the piston distal end and the chamber distal end.

2. The sound absorber as defined in claim 1, wherein the first resilient element is made of an elastomer.

3. The sound absorber as defined in claim 1, wherein the first resilient element is made of polypropylene.

4. The sound absorber as defined in claim 1, wherein the absorbing system further includes a second resilient element extending circumferencially around the piston and provided between the piston and the chamber, the second resilient element spacing apart the piston and the chamber peripheral wall from each other.

5. The sound absorber as defined in claim 4, wherein the absorbing system further includes a third resilient element extending circumferentially around the piston and provided between the piston and the chamber, the third resilient element spacing apart the piston and the chamber peripheral wall from each other, the second and third resilient elements being axially spaced apart from each other.

6. The sound absorber as defined in claim 4, wherein the second resilient element is substantially annular.

7. The sound absorber as defined in claim 6, wherein the piston defines an annular groove extending substantially circumferentially therearound, the second resilient element being mounted in the annular groove.

8. The sound absorber as defined in claim 4, wherein the second resilient element is provided substantially adjacent the chamber proximal end.

9. The sound absorber as defined in claim 4, wherein the second resilient element is made of an elastomer.

10. The sound absorber as defined in claim 4, wherein the second resilient element is made of a nitrile elastomer.

11. The sound absorber as defined in claim 1, wherein the first resilient element defines a resilient element passageway extending axially therethrough, the sound absorber further comprising a shaft extending through the first resilient element.

12. The sound absorber as defined in claim 11, wherein the chamber distal end wall is provided with a shaft receiving recess receiving part of the shaft thereinto, the shaft receiving recess being of a length sufficient to allow the shaft to move reciprocatingly thereinto when the piston and sleeve move axially relative to each other.

13. The sound absorber as defined in claim 1, wherein the chamber and piston have generally cylindrical shapes.

14. The sound absorber as defined in claim 1, further comprising a lock element extending between the piston and the sleeve to substantially prevent relative rotation of the piston and sleeve about the absorber axis.

15. The sound absorber as defined in claim 14, wherein the sleeve defines a pair of substantially diametrically opposed sleeve lock apertures extending substantially radially therethrough and the piston defines a piston lock aperture extending substantially diametrically therethrough substantially in register with the sleeve lock apertures, the lock element extending through the sleeve and piston lock apertures, the piston lock aperture being axially longer than the lock element.

16. The sound absorber as defined in claim 1, wherein the sound absorber defines an absorber passageway extending axially therethrough, the absorber passageway having parts thereof extending trough both the sleeve and the piston.

17. The sound absorber as defined in claim 1, wherein the piston defines a piston attachment at the piston proximal end and the sleeve define a sleeve attachment distally to the chamber distal end, the piston and sleeve attachments being configured and sized to mount the sound absorber between the drilling apparatus and the drill bit.

* * * * *